US005560521A

United States Patent [19]

Boring et al.

[11] Patent Number: 5,560,521

[45] Date of Patent: Oct. 1, 1996

[54] RECYCLABLE CAULK CARTRIDGE WITH BREAKAWAY NOZZLE

[75] Inventors: David E. Boring, East Berlin; Norwood C. Bizzell, Hanover, both of Pa.

[73] Assignee: Sonoco Products Company, Hartsville, S.C.

[21] Appl. No.: 398,488

[22] Filed: Mar. 6, 1995

[51] Int. Cl.[6] ..... B65D 25/00

[52] U.S. Cl. ..... 222/327; 222/541.1

[58] Field of Search ..... 222/326, 327, 222/386, 541.1, 541.3, 541.4

[56] References Cited

U.S. PATENT DOCUMENTS

| | | | |
|---|---|---|---|
| 3,071,294 | 1/1963 | Galbierz | 222/327 |
| 3,378,175 | 4/1968 | Krieps | 222/327 |
| 4,019,654 | 4/1977 | van Manen | 222/327 X |
| 5,137,184 | 8/1992 | Jackson et al. | 222/327 |
| 5,316,186 | 5/1994 | Prestele | 222/327 |
| 5,373,969 | 12/1994 | Takemura | 222/327 X |

*Primary Examiner*—Kevin P. Shaver
*Attorney, Agent, or Firm*—Dennison, Meserole, Pollack & Scheiner

[57] ABSTRACT

A caulk cartridge of recyclable material including an end panel with an integral nozzle. Interior projections integral with the end panel define a cylindrical extension about the open base end of the nozzle and, upon being subjected to the force of the piston-driven plunger thereagainst, inwardly deform and fracture the end panel, breaking away the nozzle, and residue therein, from the end panel.

12 Claims, 4 Drawing Sheets

RECYCLABLE CAULK CARTRIDGE WITH BREAKAWAY NOZZLE

BACKGROUND OF THE INVENTION

Recycling, for both environmental and economic purposes has become quite common. This is particularly the case where the material is not normally considered biodegradable, as with plastics, that is synthetic resinous materials.

In order to successfully recycle plastics, particularly plastic containers, contaminants must be kept at a minimum. This is necessary for a variety of reasons including protection of the recycling equipment and maintaining the integrity of the recycled material. To this end, it is not uncommon for limits to be established for acceptable amounts of retained contents, above which plastic containers are not considered recyclable.

This is a particular problem with conventional caulk cartridges, normally made of an appropriate rigid plastic material, for example polyethylene, in that such cartridges do not completely empty during normal usage, leaving an unacceptable residue of paste-like material, whether this be caulk, sealing compounds, adhesive, or the like.

Cartridge designs have been developed which attempt to deal with this problem of excess retained contents. Most such designs involve projections on the internal plunger which attempt to expel the last remaining volume of contents by entering into the nozzle.

Cartridges of European design do not normally include an integral nozzle as is standard in American design cartridges. Utilizing a separate releasable nozzle, a design has been developed which incorporates an interior tube extending into the cartridge. When dispensing is complete the nozzle may be removed, capturing sufficient remaining content within the interior tube to allow the separated cartridge body to be considered recyclable. However, such an arrangement cannot be applied to the standard domestic design wherein the nozzle is an integral part of the cartridge or cartridge end panel. It is also unlikely that users of the cartridges will be willing to take the time to unscrew or otherwise manually grasp and manipulate the nozzle in order to separate the recyclable portion of the cartridge.

SUMMARY OF THE INVENTION

The cartridge of the invention, principally a caulk cartridge, is formed of an appropriate recyclable synthetic resinous material, for example polyethylene, and is so constructed as to provide for a dispensing of the contents and an effective expelling of most if not all of the normally retained residue to condition the cartridge for recycling. It is significant that the expelling of the residue be accomplished without requiring a separate manual handling or manipulation of the cartridge or nozzle.

In order to achieve the desired recyclable product, the invention provides for the breaking away of the nozzle from the tubular body and the end panel, thus ensuring that the major depository of the remaining contents or residue from the tube is effectively severed therefrom. It is significant that this removal of the nozzle is effected without requiring that the nozzle be formed separate from the end panel and releasably mounted thereto, as would require a separate manual engagement and manipulation of the nozzle relative to the end panel. Rather, the nozzle of the invention can be integrally formed with the end panel, and, while functioning as a conventional nozzle in use, is ultimately broken away and discharged from the cartridge end panel by the simple expedient of continuing to actuate the cartridge gun and the forward movement of the piston driven plunger. Thus, in actual usage, the user of the cartridge need merely actuate the cartridge gun trigger a few additional times, breaking away the nozzle with the residue therein. The cartridge is then removed from the gun for recycling without requiring further cleaning or disassembly. The end panel itself is conventionally formed of the same material as the cartridge body and is recyclable therewith.

The nozzle, as is conventional, is tapered and includes an outer discharge tip, sealed and subsequently cut to size for use, and an enlarged inner base end which is integral with and opens through the generally planar end panel. In order to achieve the goals of the invention and provide for a breaking away of the nozzle as the last step in discharging the cartridge contents, the inner face of the end panel is provided with a nozzle extension comprising a series of spaced projections integral with the end panel. The projections are preferably arcuate and arranged to define a cylindrical configuration about and slightly radially outward of the inner end of the nozzle. Each of the projections includes a radial inner face extending at substantially right angles to the inner face of the end panel with a slightly rounded corner defined therebetween. The radial outer face of each projection defines a sharp angle with the inner surface of the end panel and tapers slightly therefrom toward the interior of the tube, terminating in a sharply beveled edge portion extending to the corresponding radial inner face at an inner free edge of the projection remote from the end panel.

Formed in this manner, the projections are in the path of travel of the discharge plunger with the spacing between the projections being such as to allow for a free flow of the discharging material thereby.

At the effective completion of the discharge of usable material from the cartridge body or tube, the piston driven discharge plunger is at a full-discharge position engaged against the inner beveled edges of the projections with the configuration of the projections, upon continued forward movement of the plunger, resulting in a radial inward force component on the projections and an inward folding of the projections. This will produce a reactive force at the sharp corner edge between each projection and the end panel at which a break will occur which ultimately results in a fracture of the nozzle base portion from the end panel and a complete discharge of the nozzle and projections as the plunger seats against the end panel. Any residue of caulk material or the like within the tube is discharged with the broken away nozzle and projections, thus conditioning the tube for recycling.

The full height slots or spacings between the projections, in addition to providing a passage for the free flow of the discharging materials therethrough, also encourage and allow for inward collapsing of the projections toward the center as is required to initiate the controlled fracture of the projections and nozzle base from the end panel. As will be appreciated, it is also desirable that the spacing of the slots be such as to result in a projection width several times greater than the projection thickness to preclude any possibility of any sideward failure of the projections as could disrupt the controlled fracturing.

The interior of the caulk cartridge is subject to uniform hydrostatic pressure throughout the normal dispensing strokes of the caulk gun. As such, there will be no unbalanced radial forces applied to the interior projections. Thus, the sharp corners of the projections, where the fracture will initiate, are not subject to sufficient stress to initiate the fracture until such time as axial forces are applied directly to the beveled edge portions of the projections by the advancing plunger.

Other objects, features and advantages of the invention will become more apparent from the details of the invention as more fully hereinafter set forth.

DESCRIPTION OF PREFERRED EMBODIMENT

Figures 1, 2:
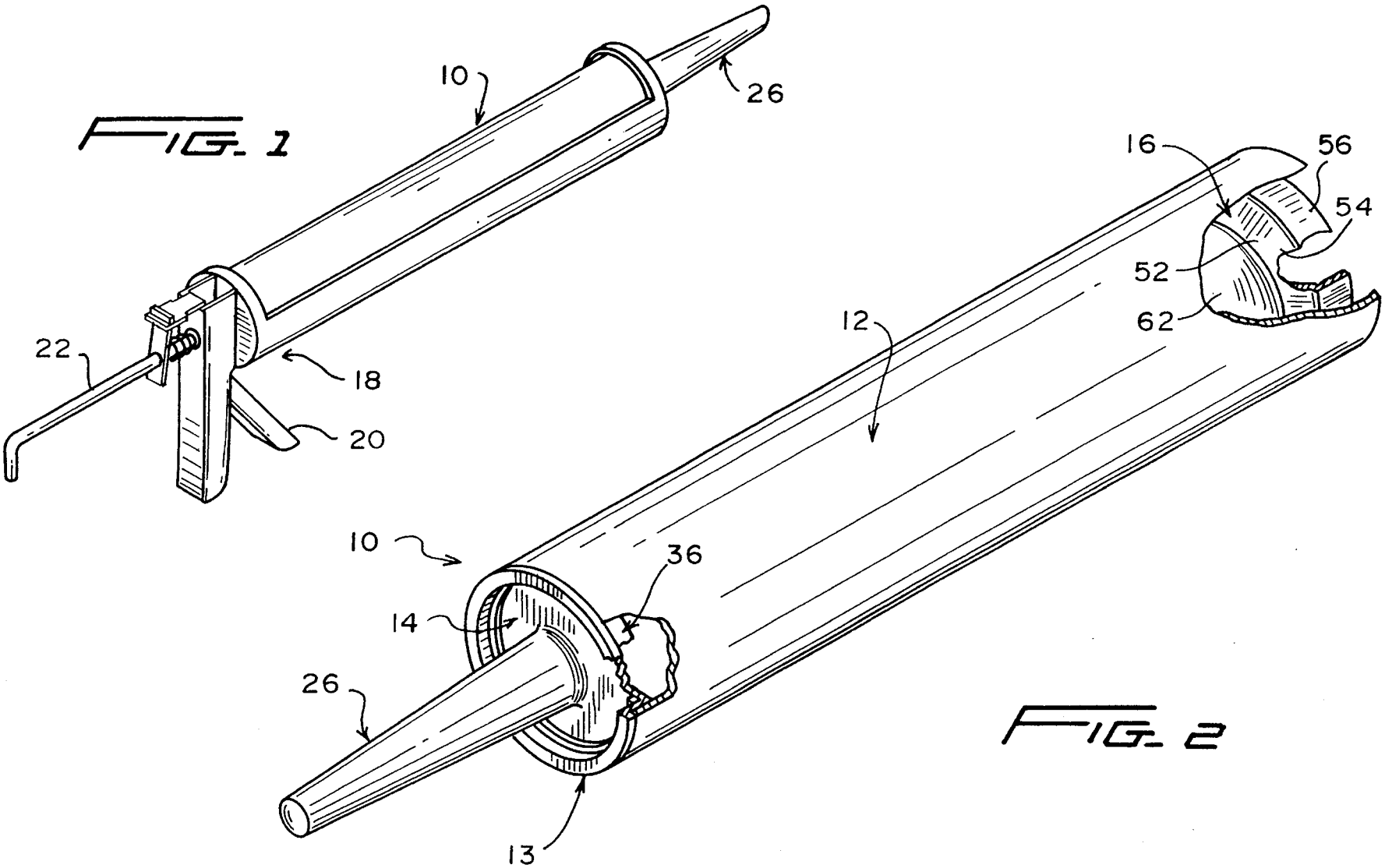
FIG. 1 is a perspective view of the cartridge of the invention mounted within a conventional caulk gun.
FIG. 2 is an enlarged perspective view, with portions broken away, of the recyclable cartridge of the invention.

Referring now more specifically to the drawings, the caulk cartridge 10 comprises an elongate cylindrical tube or body 12 having an end cap 13, including an end panel 14 and nozzle 26, on and sealed to the leading or discharge end of the body 12 in any appropriate manner conventional with such cartridges. The following end of the cartridge body 12 is closed and sealed by a sliding plunger 16 adapted, again as in a conventional cartridge, for forced forward sliding movement within the body for the forward discharge of the cartridge contents.

FIG. 1 illustrates the cartridge 10 mounted in a typical cartridge gun 18 including a manual trigger 20 which incrementally advances a piston rod 22. Noting FIG. 5 in conjunction with FIG. 1, a piston 24 mounted to the forward end of the rod 22 engages and forwardly advances the internal plunger 16.

Figure 4:
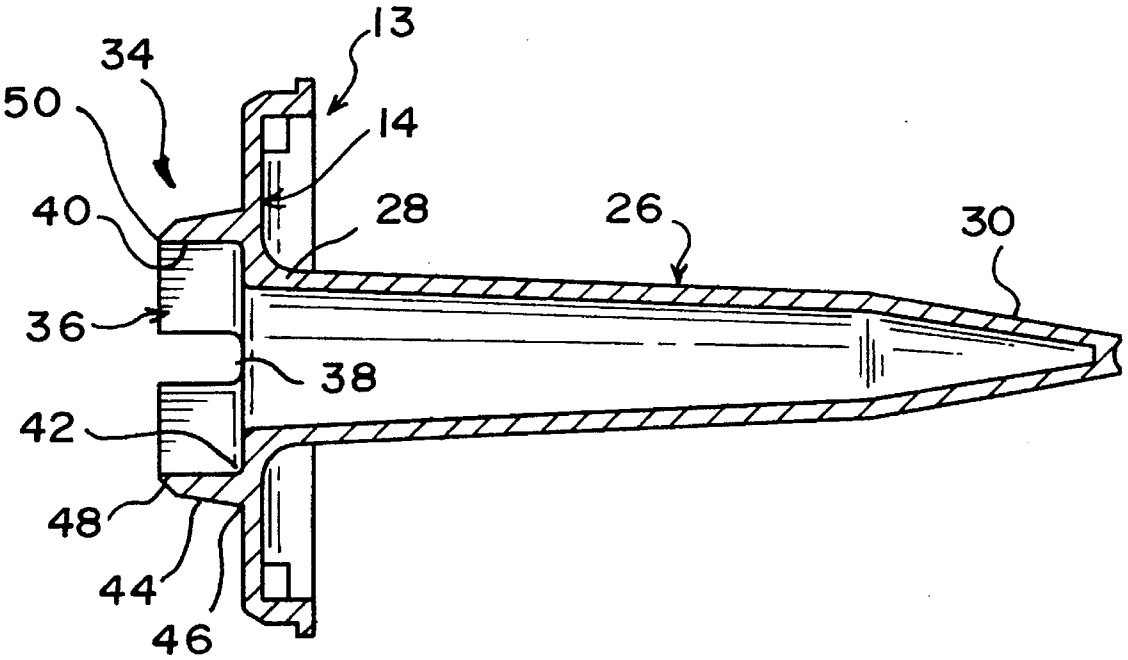
FIG. 4 is a cross-sectional view through the end panel and nozzle taken substantially on a plane passing along line 4—4 in FIG. 3.
Figure 3:
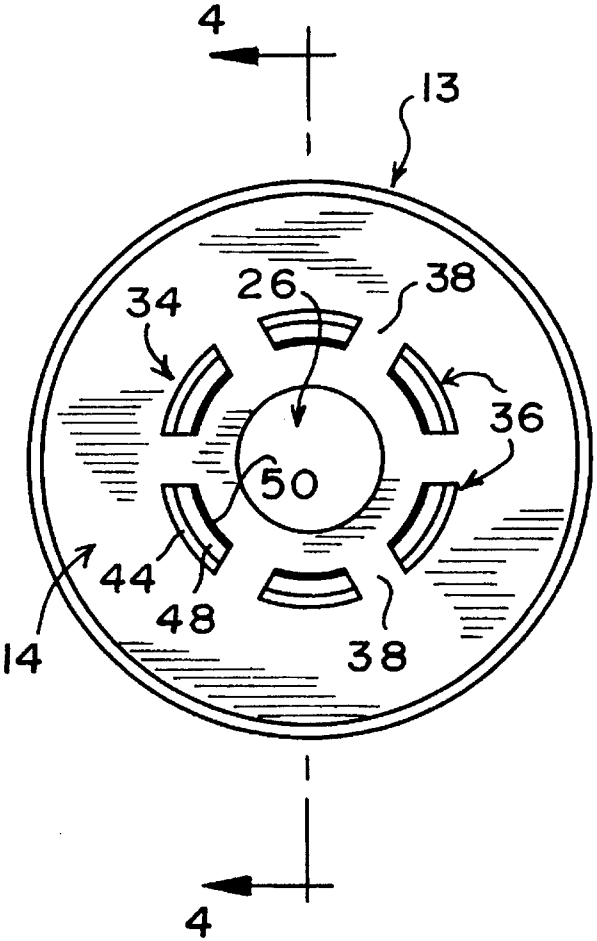
FIG. 3 is a plan view of the inner side of the end panel with the integral projections.

With particular reference to FIGS. 3 and 4, it will be seen that the discharge nozzle 26 of the cartridge 10 is, at the base end 28 thereof, integrally formed with and opens through the end panel 14 centrally thereof. The nozzle 26 tapers forwardly from the base portion 28 thereof to an outer discharge end or tip 30 which, at the time of use, is appropriately trimmed to provide the desired discharge aperture.

Projecting from the inner face 32 of the end panel 14, in opposition to the nozzle 26, is an extension 34 comprising a series of arcuate projections 36 arranged in a cylindrical configuration, with full-height slots or spaces 38 therebetween, about the base end 28 of the nozzle 26 in radially outward spaced relation thereto. The radial outward positioning of the extension projections 36 relative to the base 28 of the nozzle is minor as compared to the diametric width of the end panel 14. The projections 36, at the base ends thereof, are integral with the end panel 14.

The radial inner face 40 of each projection 36 meets the inner surface 32 of the end panel 14 at a slightly rounded inner corner defining an angle of approximately 90 degrees or slightly less. The radial outer face or surface 44 of each projection 36 defines a sharp corner-forming angle 46 of slightly greater than 90 degrees with the inner face 32 of the end panel 14. This outer face 44 converges toward the inner face 40 away from the end panel 14 and terminates in a sharply beveled edge portion 34 which in turn terminates in a free edge 50. The "sharp" corner or angle 46, as distinguished from the smooth or rounded corner, is, as noted in the cross-section views, defined by intersecting surface lines to facilitate the initiation of fracture notches as will be explained subsequently.

As will be also described subsequently, it is intended that the projections 36, upon the application of suitable direct pressure thereagainst, fold slightly radially inward for a freeing of the nozzle 26. As such, the slots or spaces 38 between the projections 36 are to allow for this necessary movement. Similarly, the width of the projections 36, as well as the thicknesses thereof, are such as to provide a degree of stability to allow for the proper dispensing of the contents of the tube, while at the same time allowing for the necessary deformation for a fracturing of the nozzle from the end panel.

Figure 5:
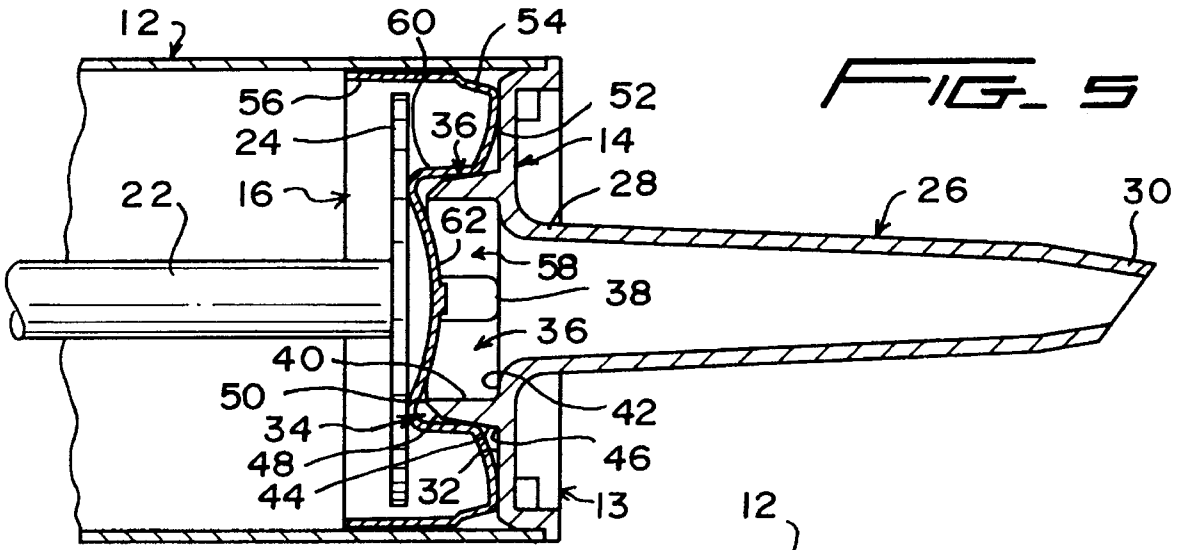
FIG. 5 is a cross-sectional detail through the end of the recyclable cartridge of the invention with the gun piston and cartridge plunger at the end of the effective discharge of the contents of the cartridge tube.
Figure 6:
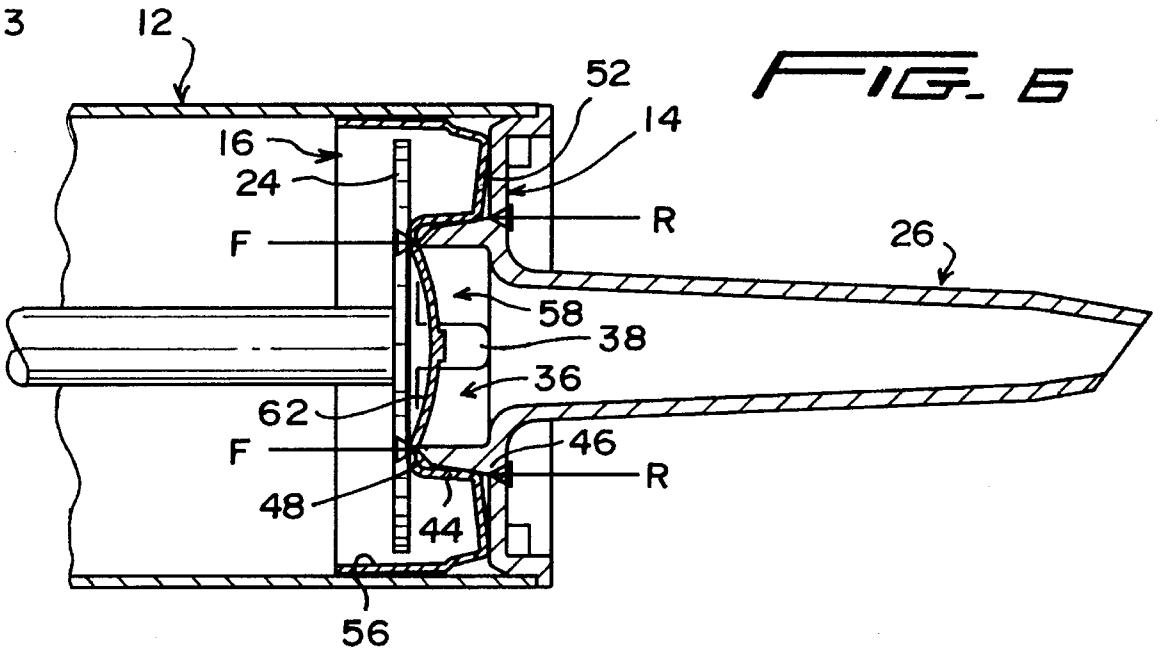
FIG. 6 is a similar cross-sectional detail illustrating initiation of the nozzle fracturing forces by continued forward movement of the gun piston.

The plunger 16, noting FIGS. 2, 5 and 6, is preferably molded as a unit and includes a lead panel 52 with an outer peripheral portion 54 inclined slightly in a radial outward direction and terminating in a cylindrical following flange 56. The flange 56 is configured to intimately and sealingly engage against the inner surface of the cartridge body 12 and to maintain this sealed relation as the plunger is forwardly moved by the piston 24 during the discharge of material. The flange is preferably relatively wide to ensure the stability of the plunger during movement and avoid any tendency for the plunger to tilt or cant.

The lead panel 52 of the plunger 16 slopes radially inward from the peripheral edge portion 54 and includes a central guide pocket 58 opening forwardly along the direction of travel of the plunger 16. The pocket 58 includes a peripheral wall 60 which closely telescopically receives the arcuate projections 36 therein, initially engaging these projections at approximately mid height along the tapered outer surfaces 44 thereof. The bottom 62 of the pocket 58 is slightly forwardly convex to provide a degree of rigidity both to the pocket bottom 62 and the pocket wall 60 to ensure a proper forward movement and pressure against the cartridge material as the material is being discharged.

Attention is now particularly directed to FIGS. 5–8 which sequentially illustrate the piston-induced movement of the plunger from its full-discharge position seated against the end panel at the normal completion of the discharge of material from the cartridge body, through the final position of the plunger whereat the nozzle is fractured and released from the end panel.

In FIG. 5, the plunger 16, at the effective completion of the discharge of material, receives the multiple projection extension 34 within the central guide pocket 58, with the forward face of the lead panel 52 seating against the under or inner surface of the end panel 14. The annular wall 60 of the plunger pocket 58 engages and confines the spaced projections 36.

Upon a discharge of the usable material from the cartridge body, substantial residue will remain within the nozzle. As previously discussed, it is essential that this residue be removed in order to allow for recycling of the cartridge. To effect this, the integral nozzle, with the residue therein, is fractured from and dropped off of the end panel. Thus, and noting FIG. 6, after discharge of the usable material as noted with regard to FIG. 5, continued actuation of the gun trigger and forward movement of the piston 24 brings the peripheral portion of the pocket bottom wall into intimate engagement with the beveled arcuate edge portions of the projections 36, developing applied forces F on the extreme edges. These forces F, in light of the beveled edge portions 48 and the inclined outer surfaces 44 of the projections 36, produce a radial inward force component which tends to radially inwardly fold the projections 36 and in turn produce a reaction force or stress area at the sharply defined outer corners 46, thus initiating a fracture, suggested at 47, where the outer surfaces 44 of the projections 36 join the inner face 32 of the end panel 14.

Figure 7:
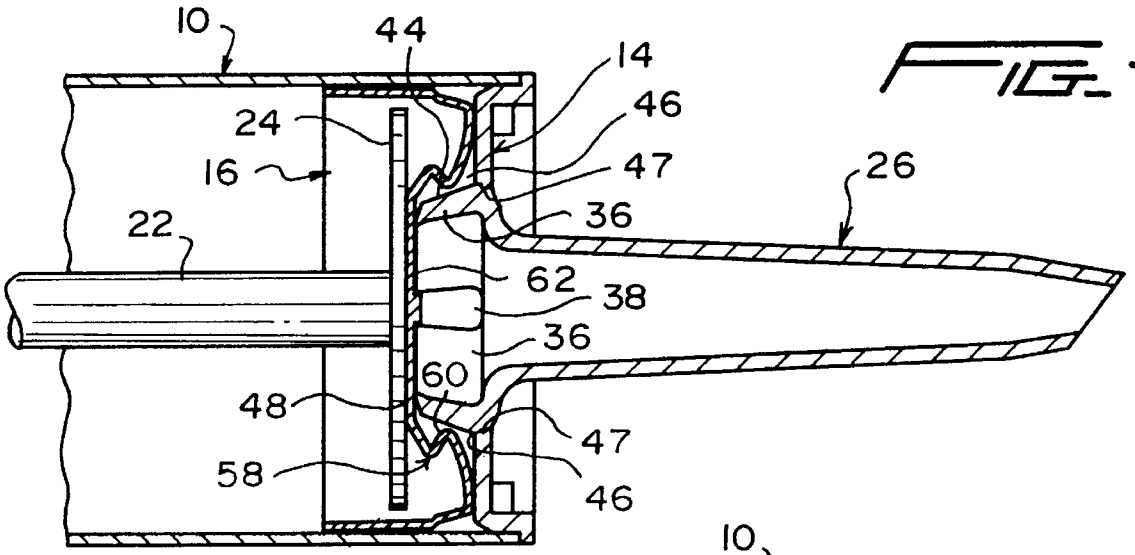
FIG. 7 is a similar cross-sectional detail illustrating the positioning of the components at approximately the point of fracture initiation.

Continued discharge movement of the piston-driven plunger, noting FIG. 7, will produce a continued inward rotation of the projections toward each other, accommodated by the slots 38, thus increasing the stress at the joinder area of the projections 36 with the end panel 14. The plunger leading panel 52, engaging against the under surface of the end panel 14 radially outward of the projections 36, will act to stabilize the end panel as stress is increased.

Figure 8:
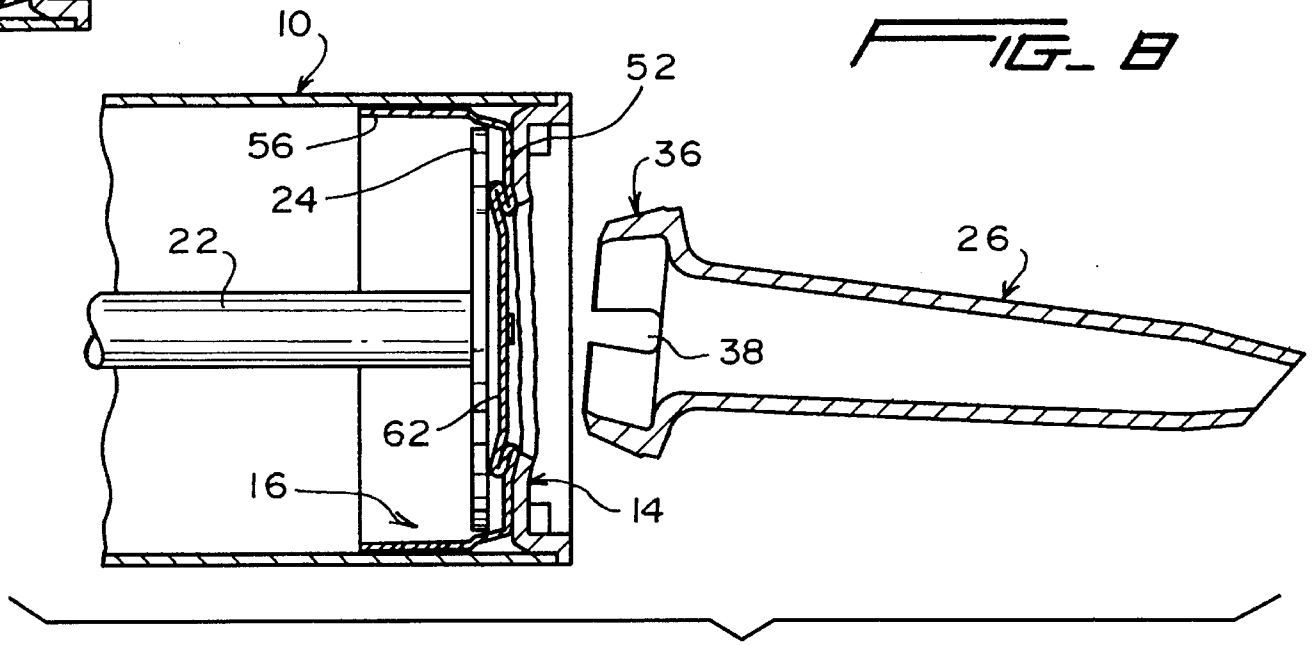
FIG. 8 is a similar cross-sectional detail illustrating the discharge of the broken-away nozzle and the full collapse of the plunger against the end panel.

Ultimately, and noting FIG. 8, the nozzle 26 and the projections 36 still integrally join to the base portion of the nozzle, break away or fracture as a unit from the cartridge end panel 14 for complete discharge therefrom as the piston crushes the plunger 16 flat against the inner surface of the end panel 14. Any residue within the nozzle, or for that matter confined between the projections, discharges with the fractured nozzle. Upon retraction of the piston in the normal manner, the cartridge is ready for recycling.

It is to be appreciated that all of the components of the cartridge, including the body, end panel and plunger are of compatible recyclable material, normally an appropriate synthetic resinous material such as polyethylene. It is also to be appreciated that the discharge end of the cartridge gun itself is to have the nozzle-accommodating slot therein of an appropriate configuration as to not interfere with the outward fracturing of the nozzle from the end panel.

The interior of the cartridge body is subjected to uniform hydrostatic pressure throughout the dispensing of the material, with the slots providing for free movement of the material between the inner and outer faces of the projections. As such, there will be no unbalanced radial forces applied to the projections and the nozzle joinder area during normal material dispensing. The initiation of the fracture at the sharp corner at the base of each projection will only occur when axial forces are applied directly to the free inner ends of the projections by the piston driven plunger forcibly engaging thereagainst.

The foregoing is illustrative of a preferred embodiment of the invention. However, it is intended that the invention, defined in the claims hereinafter, encompass all embodiments incorporating the principles of the invention.

We claim:

1. A recyclable cartridge for the dispensing of paste-like materials, said cartridge comprising an elongate tubular body having a forward discharge end and a rear end, an end cap fixed to and sealing said discharge end, said end cap comprising an end panel overlying and closing said forward discharge end and a nozzle rigid with and projecting forwardly from said end panel, a discharge plunger within said body for confining dispensable material therein, said discharge plunger being selectively forwardly slidable toward said forward discharge end for selective discharge of material through said nozzle, a forward, full-discharge position for said plunger assumed by said plunger upon full discharge of usable material from said body, said plunger being forwardly movable beyond said full-discharge position, a fracturable area defined between said end panel and said nozzle for selective separation of said nozzle from said end panel, force transfer means inward of said end cap, said force transfer means being within the path of travel of said plunger forward from said full-discharge position for engagement by said plunger for transfer of force of said forwardly moving plunger to said fracturable area for separation of said nozzle from said end panel.

2. The recyclable cartridge of claim 1, wherein said force transfer means comprises an extension joined to said end panel and extending rearwardly therefrom into said cartridge and in generally coaxial relation to said nozzle, said fracturable area being defined at the joinder of said extension and said end panel.

3. The recyclable cartridge of claim 2, wherein said extension comprises projections positioned about said nozzle in peripherally spaced relation to each other.

4. The recyclable cartridge of claim 3, wherein each projection is arcuate with said projections defining a generally cylindrical configuration, each projection having a radial inner face generally perpendicular to said end panel, and a radial outer face which angles toward said inner face and defines a free edge remote from said end panel for engagement by said plunger upon forward movement of said plunger from said full-discharge position wherein a radial inward folding of said projections is initiated.

5. The recyclable cartridge of claim 4, wherein said fracturable area is defined in said end panel immediately radially outward of said projections, said projection outer surfaces meeting said end panel at sharply defined angles wherein inward folding of the projections will initiate fracture at said defined angles.

6. The recyclable cartridge of claim 5, wherein said plunger includes a forwardly opening central pocket defined therein and closely receivable about said force transfer extension projections with said plunger in said full-discharge position and forwardly thereof for stabilization of said projections upon initiation of inward folding of said projections.

7. The recyclable cartridge of claim 6, wherein said nozzle is integrally formed with said end panel.

8. The recyclable cartridge of claim 2, wherein said extension includes a radial inner face extending generally perpendicular to said end panel, and a radial outer face generally converging toward said inner face remote from said end panel and defining a plunger-engaging free edge on said extension, said extension inwardly folding upon forced engagement of said plunger thereagainst, said fracturable area being defined in said end panel immediately adjacent said extension and including a sharp angle defined between said extension radial outer surface and said end panel to in turn define a point of initiation of fracture as said extension inwardly folds.

9. The recyclable cartridge of claim 8, wherein said plunger includes a forwardly opening central pocket defined therein and closely receivable about said force transfer extension with said plunger in said full-discharge position and forwardly thereof for stabilization of said extension upon initiation of inward folding of said extension.

10. The recyclable cartridge of claim 9, wherein said nozzle is integrally formed with said end panel.

11. For use in a recyclable caulk cartridge; an end cap, said end cap comprising an end panel having an outer face and an inner face, a nozzle integrally formed with said end panel centrally thereof and projecting outward from said end panel outer face, a plurality of projections integral with said end panel and projecting inward from said end panel inner face, said projections surrounding said nozzle in radial outwardly spaced relation thereto, said projections being peripherally spaced from each other, defining passages therebetween and allowing for selective radial inward folding of said projections.

12. the end cap of claim 11, wherein each projection has a radial outer face meeting said inner face of said end panel at a sharply defined angle, said projection outer faces being beveled toward free ends thereof remote from said end panel.

* * * * *